US007683793B2

(12) United States Patent
Li et al.

(10) Patent No.: US 7,683,793 B2
(45) Date of Patent: Mar. 23, 2010

(54) TIME-DEPENDENT CLASSIFICATION AND SIGNALING OF EVACUATION ROUTE SAFETY

(75) Inventors: Qing Li, Shanghai (CN); Thomas A. Plocher, Hugo, MN (US)

(73) Assignee: Honeywell International Inc., Morristown, NJ (US)

( * ) Notice: Subject to any disclaimer, the term of this patent is extended or adjusted under 35 U.S.C. 154(b) by 175 days.

(21) Appl. No.: 11/447,639

(22) Filed: Jun. 6, 2006

(65) Prior Publication Data

US 2007/0279210 A1 Dec. 6, 2007

(51) Int. Cl.
*G08B 17/10* (2006.01)

(52) U.S. Cl. ..... 340/628; 340/573.1; 340/584; 340/588; 702/1

(58) Field of Classification Search ..... 340/506, 340/521–522, 524–525, 332, 584–600, 628, 340/573.1; 702/1; 705/9; 236/49; 165/281; 62/176.6; 454/322
See application file for complete search history.

(56) References Cited

U.S. PATENT DOCUMENTS

| | | | | |
|---|---|---|---|---|
| 6,496,110 | B2 * | 12/2002 | Peterson et al. | 340/522 |
| 6,590,496 | B2 * | 7/2003 | Peterson et al. | 340/522 |
| 6,778,071 | B2 | 8/2004 | Megerle | 340/332 |
| 7,233,781 | B2 * | 6/2007 | Hunter et al. | 455/404.1 |
| 2004/0036579 | A1 | 2/2004 | Megerle | |
| 2004/0201470 | A1 | 10/2004 | Reed | |
| 2005/0128070 | A1 | 6/2005 | Faltesek et al. | 340/524 |
| 2005/0128071 | A1 | 6/2005 | Faltesek | |
| 2005/0209770 | A1 * | 9/2005 | O'Neill et al. | 701/117 |
| 2005/0231349 | A1 | 10/2005 | Bhat | 340/506 |
| 2005/0267651 | A1 * | 12/2005 | Arango et al. | 701/3 |
| 2007/0219645 | A1 * | 9/2007 | Thomas et al. | 700/29 |

OTHER PUBLICATIONS

PCT-Notification of Transmittal of The International Search Report and the Written Opinion of the International Searching Authority, or the Declaration, Date of Mailing Dec. 13, 2007.

* cited by examiner

*Primary Examiner*—George A Bugg
(74) *Attorney, Agent, or Firm*—Kermit D. Lopez; Luis M. Ortiz; Ortiz & Lopez, PLLC

(57) ABSTRACT

An adaptive evacuation system and method for providing a safety route to evacuees. Active smoke and heat detector information can be obtained from a fire panel. Routes and exits in proximity to the active detectors are assumed to be unsafe and closed for use in evacuation. Evacuation planning is accomplished with the remaining "safe" routes. The progression of fire and smoke and the time-dependent degradation of evacuation route safety associated with progression of fire and smoke can be predicted and initial classification and signaling of route safety can be performed. As the fire progresses, the initial time-dependent classifications are updated and initially safe routes are reclassified as unsafe and then evacuation directions are modified.

20 Claims, 7 Drawing Sheets

TIME-DEPENDENT CLASSIFICATION AND SIGNALING OF EVACUATION ROUTE SAFETY

TECHNICAL FIELD

Embodiments are generally related to data-processing methods and systems. Embodiments are additionally related to evacuation systems and method. Embodiments are also related to time-dependent classification and the signaling of safety evacuation route.

BACKGROUND OF THE INVENTION

Typically, during an emergency evacuation of a building, occupants must make their own assessment regarding the relative safety of possible egress routes and select a route that they perceive as safe. Under the stress of time pressure and uncertainty, an occupant's assessment and choice of safety route may be faulty. Frequently, the default choice made by an occupant involves either evacuating along the same route that he or she used to enter the building that day, or moving toward a known fixed emergency exit that may or may not be safe. Adaptive evacuation systems offer the potential to relieve the occupant of these difficult egress decisions.

In conditions where it is difficult to find a safe path out of a building, indications as to which of the escape routes is/are safe and indications of how to get to that escape route can be very valuable. In more severe emergencies such as earthquakes, parts of a building may have collapsed. This severe damage can block the path to safe egress routes. Further, any changes in the building due to a collapse can combine with smoke and dust to become very disorienting.

In a severe fire, the whole process of searching for safety evacuation routes may become even more difficult if thick smoke fills the entire structure. In a severe fire, evacuee panic can combine with obscuration by heavy smoke to create severe disorientation in the evacuees. These difficulties can be further aggravated if the fire spreads so rapidly that the escape routes are blocked or cut off by the fire.

In conditions where it might be difficult to find a safe way out of a building, indications of where the safe egress routes are located would be very helpful. On the other hand, first responders, especially fire fighters, often have considerable difficulty in navigating through buildings during an emergency. Fire fighters have a difficult time determining their location in the building, and where they can go when smoke is thick. Fire fighters often do not know the building layout well, and do not have accurate information for navigating toward an identified location. As a result the fire fighter can be become lost. Fire fighters also often have a difficult time finding multiple objectives such as the fire, standpipes, and the suspected locations of victims, who must be found quickly.

It is important for fire fighting crews to go directly to the fire when they arrive at a fire scene. Even if the location of the fire is known, getting to the fire can be a challenging task due to a lack of knowledge of the building layout. Fire fighters also need other important information such as the need to travel to water supplies, victims, or special hazards.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved adaptive building evacuation system and method.

It is another aspect of the present invention to provide a time-dependent classification and signaling of a safety evacuation route.

The aforementioned aspects and other objectives and advantages can now be achieved as described herein. An adaptive evacuation method and system is disclosed. Data concerning a hazard from a plurality of hazard detectors monitoring a region of interest can be automatically predicted. Thereafter, how the hazard propagates over time from a current location of the hazard can be predicted using a prediction model in order to evaluate, classify and communicating one or more safety evacuation routes to one or more evacuees, thereby providing a time-dependent classification and signaling of evacuation route(s).

The adaptive evacuation system receives information from a fire panel about currently active smoke and heat detectors. Routes and exits in proximity to the active detectors are assumed to be unsafe and closed for use in evacuation. Evacuation planning is done with the remaining "safe" routes. But, fires are dynamic and often spread from one area to another over time. Smoke also spreads over time, often unintentionally aided by the building HVAC (Heating, Ventilation, Air Conditioning) system.

Predicting the progression of fire and smoke and the time-dependent degradation of evacuation route safety associated with it, would allow the initial classification and signaling of the degree of route safety. As the fire progressed, the initial time-dependent classification could be updated, with some initially safe routes reclassified as unsafe and evacuation directions modified.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Note that the embodiments disclosed herein can be implemented in the context of a host operating system and one or more software modules. Such modules may constitute hardware modules, such as, for example, electronic components of a computer system. Such modules may also constitute software modules. In the computer programming arts, a software module can be typically implemented as a collection of routines and data structures that performs particular tasks or implements a particular abstract data type.

Software modules generally comprise instruction media storable within a memory location of a data-processing apparatus and are typically composed of two parts. First, a software module may list the constants, data types, variable, routines and the like that can be accessed by other modules or routines. Second, a software module can be configured as an implementation, which can be private (i.e., accessible perhaps only to the module), and that contains the source code that actually implements the routines or subroutines upon which the module is based. The term module, as utilized herein can therefore refer to software modules or implementations thereof. Such modules can be utilized separately or together to form a program product that can be implemented through signal-bearing media, including transmission media and recordable media. An example of such a module is module 122 depicted in FIG. 1.

It is important to note that, although the present invention is described in the context of a fully functional data-processing apparatus (e.g., a computer system), those skilled in the art will appreciate that the mechanisms of the present invention are capable of being distributed as a program product in a variety of forms, and that the present invention applies equally regardless of the particular type of signal-bearing media utilized to actually carry out the distribution. Examples of signal bearing media include, but are not limited to, recordable-type media such as floppy disks or CD ROMs and transmission-type media such as analogue or digital communications links.

The embodiments disclosed herein may be executed in a variety of systems, including a variety of computers running under a number of different operating systems. The computer may be, for example, a personal computer, a network computer, a mid-range computer or a mainframe computer. In the preferred embodiment, the computer is utilized as a control point of network processor services architecture within a local-area network (LAN) or a wide-area network (WAN).

Figure 1:
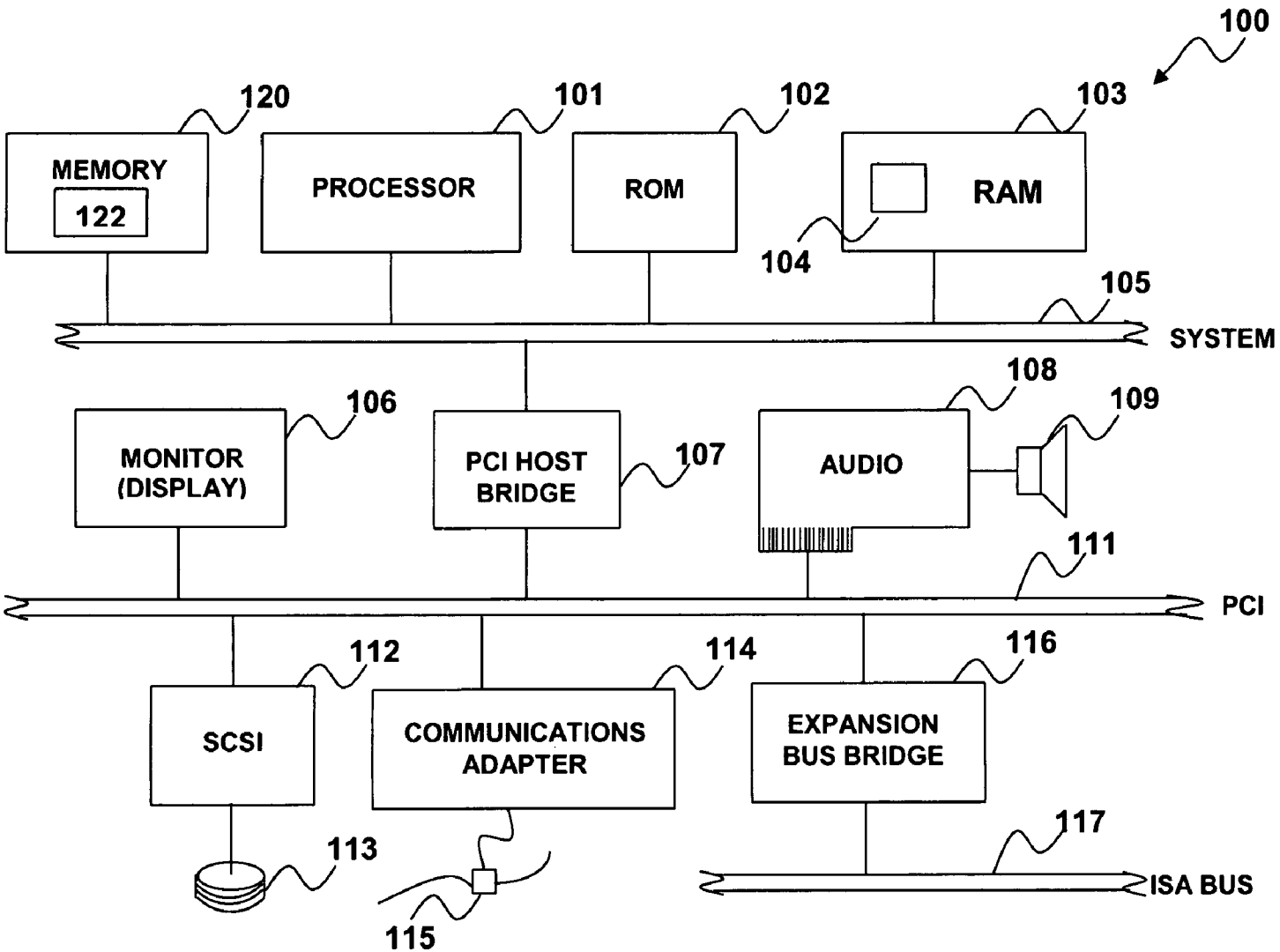
FIG. 1 illustrates a block diagram of a representative data-processing apparatus in which a preferred embodiment can be implemented.

Referring now to the drawings and in particular to FIG. 1, there is depicted a block diagram of a representative data-processing apparatus 100 (e.g., a computer) in which a preferred embodiment can be implemented. As shown, processor (CPU) 101, Read-Only memory (ROM) 102, and Random-Access Memory (RAM) 103 are connected to system bus 105 of data-processing apparatus 100. A memory 120 can also be included which includes a module 122 as described above. Memory 120 can be implemented as a ROM, RAM, a combination thereof, or simply a general memory unit. Depending upon the design of data-processing apparatus 100, memory 120 may be utilized in place of or in addition to ROM 102 and/or RAM 103.

Data-processing apparatus thus includes CPU 101, ROM 102, and RAM 103, which are also coupled to Peripheral Component Interconnect (PCI) local bus 111 of data-processing apparatus 100 through PCI host-bridge 107. PCI Host Bridge 107 provides a low latency path through which processor 101 may directly access PCI devices mapped anywhere within bus memory and/or input/output (I/O) address spaces. PCI Host Bridge 107 also provides a high bandwidth path for allowing PCI devices to directly access RAM 103.

Also attached to PCI local bus 111 are communications adapter 114, small computer system interface (SCSI) 112, and expansion bus-bridge 116, communications adapter 114 is utilized for connecting data-processing apparatus 100 to a network 115. SCSI 112 is utilized to control high-speed SCSI disk drive 113. Expansion bus-bridge 116, such as a PCI-to-ISA bus bridge, may be utilized for coupling ISA bus 117 to PCI local bus 111. In addition, audio adapter 108 is attached to PCI local bus 111 for controlling audio output through speaker 109. Note that PCI local bus 111 can further be connected to a monitory 106, which functions as a display (e.g., a video monitor) for displaying data and information for a user and for interactively displaying a graphical user interface (GUI). In alternate embodiments, additional peripheral components may be added or existing components can be connected to the system bus. For example, the monitor 106 and the audio component 108 along with speaker 109 can instead be connected to system bus 105, depending upon design configurations.

Data-processing apparatus 100 also preferably includes an interface such as a graphical user interface (GUI) and an operating system (OS) that reside within machine readable media to direct the operation of data-processing apparatus 100. In the preferred embodiment, OS (and GUI) contains additional functional components, which permit network-processing components to be independent of the OS and/or platform. Any suitable machine-readable media may retain the GUI and OS, such as RAM 103, ROM 103, SCSI disk drive 113, and other disk and/or tape drive (e.g., magnetic diskette, magnetic tape, CD-ROM, optical disk, or other suitable storage media). Any suitable GUI and OS may direct CPU 101.

Further, data-processing apparatus 100 preferably includes at least one network processor services architecture software utility (i.e., program product) that resides within machine-readable media, for example a custom defined service utility 104 within RAM 103. The software utility contains instructions (or code) that when executed on CPU 101 interacts with the OS. Utility 104 can be, for example, a program product as described herein. Utility 104 can be provided as, for example, a software module such as described above.

Figure 2:
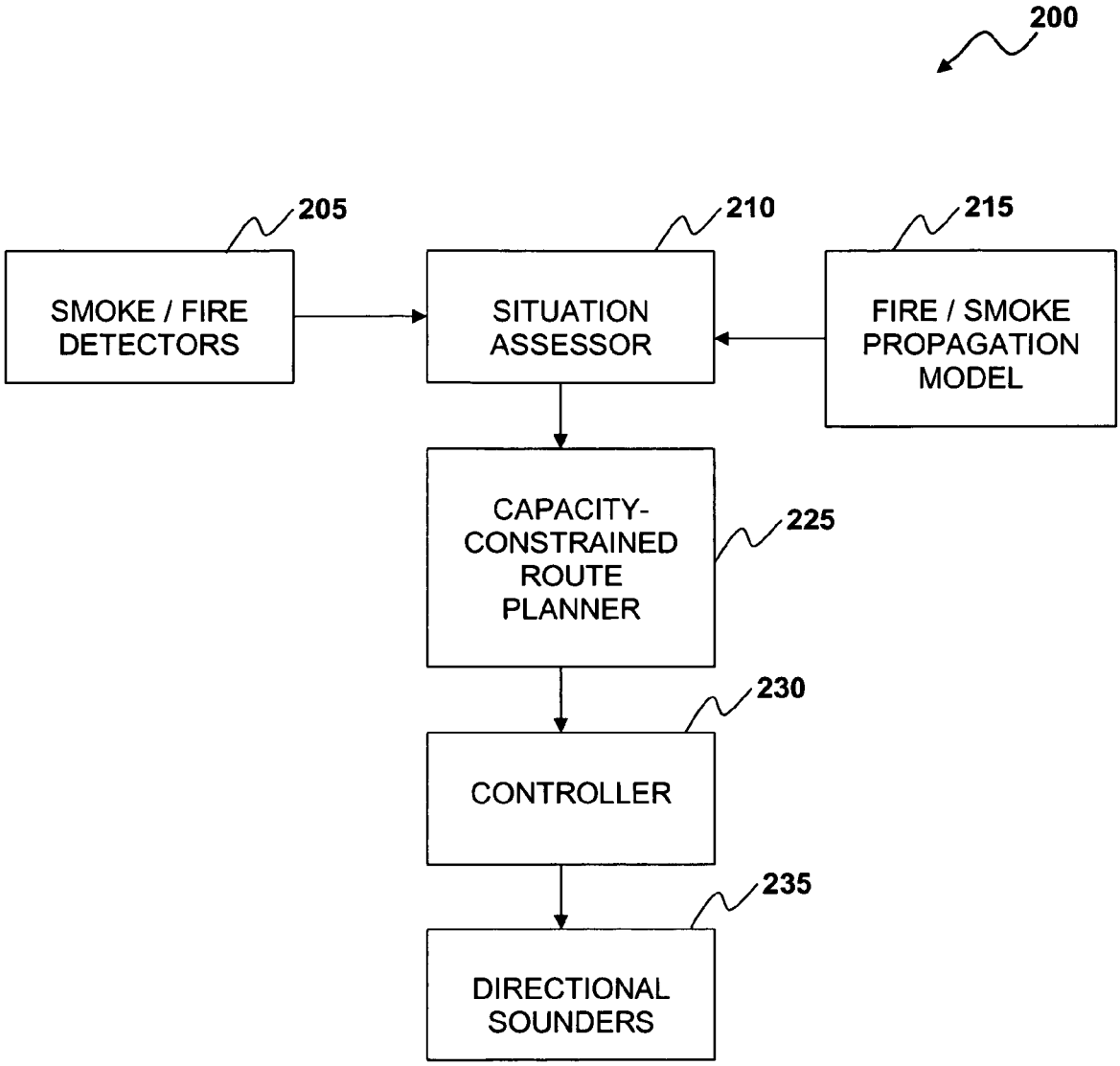
FIG. 2 illustrates a block diagram of an adaptive evacuation system, which can be implemented in accordance with a preferred embodiment.

FIG. 2 illustrates a block diagram of an adaptive evacuation system 200, which can be implemented in accordance with a preferred embodiment. System 200 depicted in FIG. 2 generally includes a plurality of detectors 105 for monitoring a region(s) of interest. The detectors 205 can include, without limitation, detecting devices such as flame detection upon detecting heat detectors, smoke detectors, window position or integrity sensors, door security sensors, motion detectors, or door crash alarms. Other sensors including those that incorporate the use of advanced image processing techniques can be utilized to detect smoke and/or fire can be implemented as one or more of detectors 205. Audio sensors can also be utilized to detect fire, an individual's location, or panic. Other types of sensors that could be used to detect a panic, a stampede, a fire, and/or temperature changes include image processing and/or infrared based image processing systems.

A fire or smoke propagation model 215 can be utilized to detect spread paths over time of smoke or fire. The smoke propagation model 215 can be implemented as a software module, such as, for example, module 122 depicted in FIG. 1. A situation assessor 210 evaluates, predicts and classifies safety route for evacuation of occupants using the data from active detectors and other detectors or sensors and the fire and smoke propagation model. The situation assessor 210 can also be implemented in the context of one or more software modules, such as module 122. A capacity constrained route planner 225 calculates at least one evacuation plan based on the safety rotes obtained from the situation assessor. The capacity constrained route planner 224 can also be implemented as a software module, such as module 122. A controller 230 can be utilized to control the output patterns of one or more directional sound devices 235 such as, for example, an "ExitPoint™" directional sounder, in order to communicate at least one evacuation path to the evacuees. Note that the ExitPoint™ directional sounder is a product of the "System Sensor" company headquartered in St. Charles, Ill., U.S.A. The ExitPoint™ directional sounder represents only one example of a directional sounder that can be adapted for use with the disclosed embodiments. It can be appreciated that other types of directional sounding devices can also be utilized and that the ExitPoint™ directional sounder is not a limiting feature of the embodiments. The ExitPoint™ directional sounder includes an integral audio amplifier that produces a broadband low-, mid-, and/or high-, range sound in specific pulse patterns. The ExitPoint™ directional sounders, fitted in addition to the normal building evacuation sounders, offer a technique for drawing people to evacuation routes even in perfect visibility. The ExitPoint™ directional sounder can function equally in smoke-filed environments. Triggered by existing fire detection systems, directional sounders positioned at carefully selected locations can guide building occupants along escape routes and to perimeter building exits.

Figure 3:
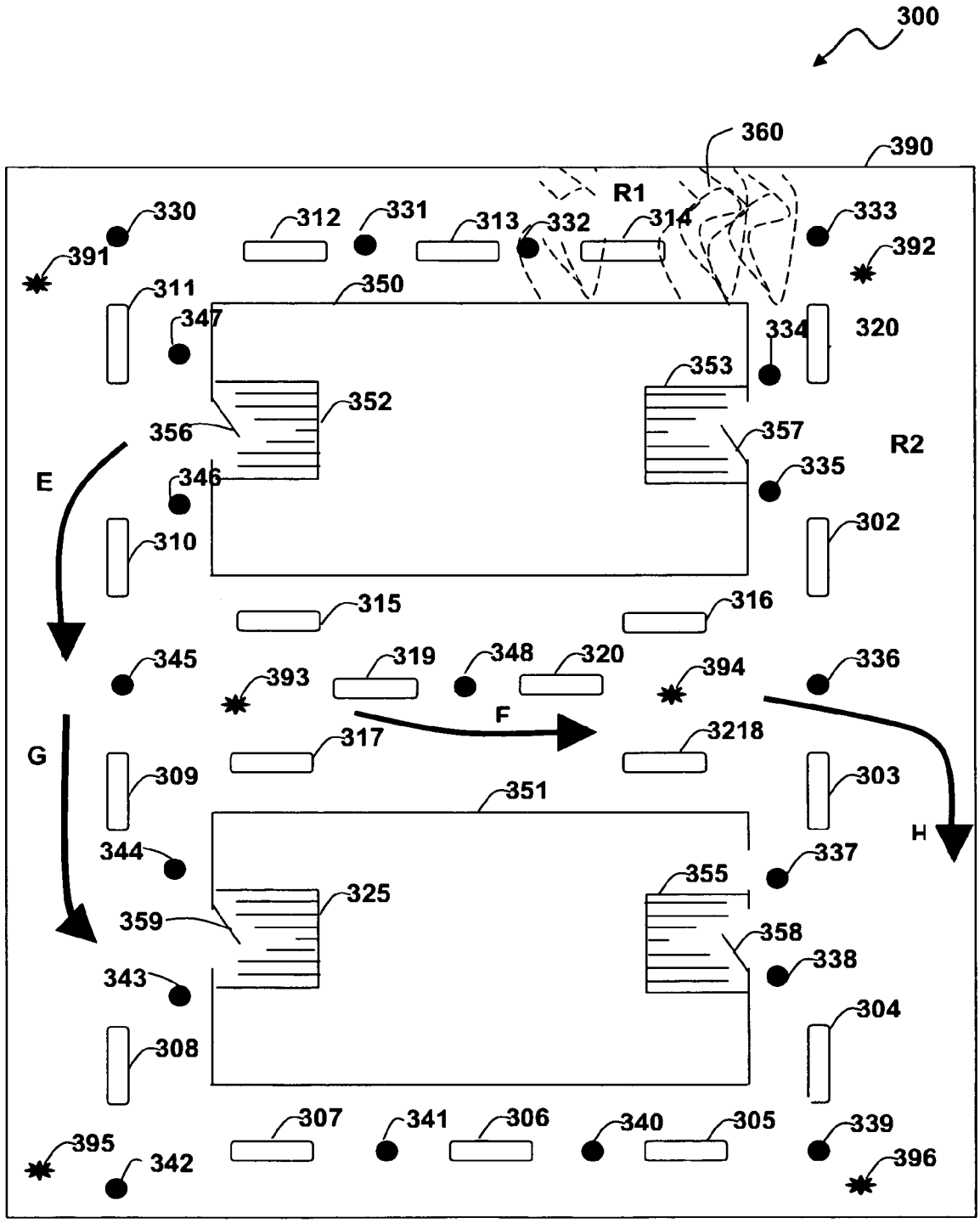
FIG. 3 illustrates a top plan view of a building being monitored by an adaptive evacuation system as in FIG. 2 during a hazardous condition in a region R1, which can be implemented in accordance with a preferred embodiment.

FIG. 3 illustrates a top plan view 300 of a building being monitored by the adaptive evacuation system 200 of FIG. 2 during hazardous condition 360 in a region R1, in accordance with a preferred embodiment. The FIG. 3 shows a pair of buildings 350 and 351 of a type commonly found in multistory buildings. Each building has a pair of doors 356, 357 and 359, 358 and a pair of stairs 352, 353 and 354, 355 respectively. The whole system depicted in FIG. 2 is installed inside a compound wall 390 of the buildings 350 and 351.

In FIG. 3, a hazardous condition 360, for instance a fire or gas condition has developed in the region R1 adjacent to a door 357. The smoke or heat detectors 205 depicted in FIG. 2, generally represent the smoke or heat detectors 301-320 depicted in FIG. 3. A plurality of visual signaling devices 330-348 are used to indicate the safety routes to the evacuees. The directional sounders 235 depicted in FIG. 2, generally represent the directional sounders 301-320 depicted in FIG. 3. The hazardous condition 360 is sensed by the active detectors such as 314, 313 and 301 and other detectors such as 302-312 and 315-320 in side the compound wall 390. The system 200 of FIG. 2 processes the signals from the detectors 301-320 and an evacuation plan is prepared using the processed signals.

The visual signaling devices 330, 331, 332, 333 and 334 near the hazardous condition 360 are indicated in red color in order to show the evacuees that the route is unsafe for evacuation. The visual signaling devices 347, 335, 346, 336, 348 and 345 are indicated in yellow color in order to show the evacuees that the route is currently safe but will be unsafe soon (e.g., in 1-5 minutes) for evacuation. The visual signaling devices 344, 343, 342, 341, 340, 338, 337 and 339 far apart from the hazardous condition 360 are indicated in green color in order to show the evacuees that the route is safe for evacuation. The directional sounders 301-320 produce audio signals to the evacuees, based on the smoke spread paths and speeds. The evacuees can choose any of the routes E, F, H and G according to the visual signals indicated by visual signaling devices 330-348 and audio signals produce by directional sounders 301-220.

Figure 4:
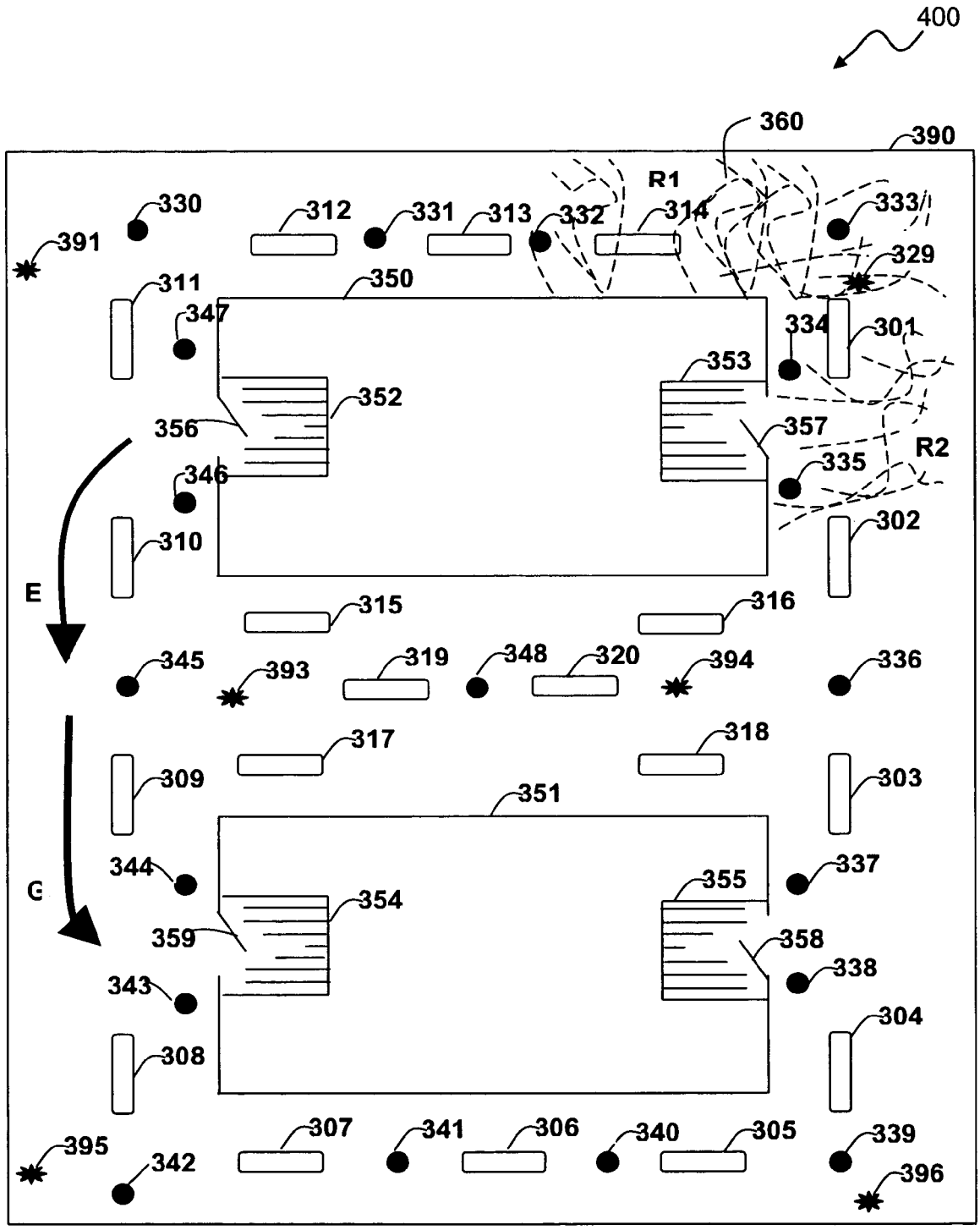
FIG. 4 illustrates a top plan view of a building being monitored by the adaptive evacuation system of FIG. 2 during a hazardous condition propagated from a regions R1 to a region R2, in accordance with a preferred embodiment.

FIG. 4 illustrates a top plan view of a building 400 being monitored by the adaptive evacuation system of FIG. 2 during a hazardous condition 360 propagated from a region R1 to a region R2, d in accordance with a preferred embodiment. Note that in FIGS. 2-4, identical or similar parts or elements are indicated by identical reference numerals. Thus, the FIG. 4 also contains the visual signaling devices 330-348, detectors 301-320, stairs 352-355, doors 256-259, building 350 and 351, hazardous condition 360 and a compound wall 309.

The hazardous condition 360 for example fire gets propagated from the region R1 to the region R2 as shown in FIG. 4. The hazardous condition 360 is sensed by the active detectors such as 314, 313, 302 and 301 and other detectors such as 303-312 and 315-320 in side the compound wall 390. The system 200 of FIG. 2 processes the signals from the detectors 301-320 and an evacuation plan is prepared using the processed signals.

The visual signaling devices 330, 331, 332, 334 and 335 near the hazardous condition 360 are indicated in red color in order to show the evacuees that the route is unsafe for evacuation. The visual signaling devices 347, 346, 336, 348 and 345 are indicated in yellow color in order to show the evacuees that the route is currently safe but will be unsafe soon (e.g., in 1-5 minutes) for evacuation. The visual signaling devices 344, 343, 342, 341, 340, 338, 337 and 339 far apart from the hazardous condition 360 are indicated in green color in order to show the evacuees that the route is safe for evacuation. The directional sounders 301-320 produce audio signals to the evacuees, based on the smoke spread paths and speeds. The evacuees can choose any of the routes E and G according to the visual signals indicated by visual signaling devices 330-348 and audio signals produced by directional sounders 310-320.

Figure 5:
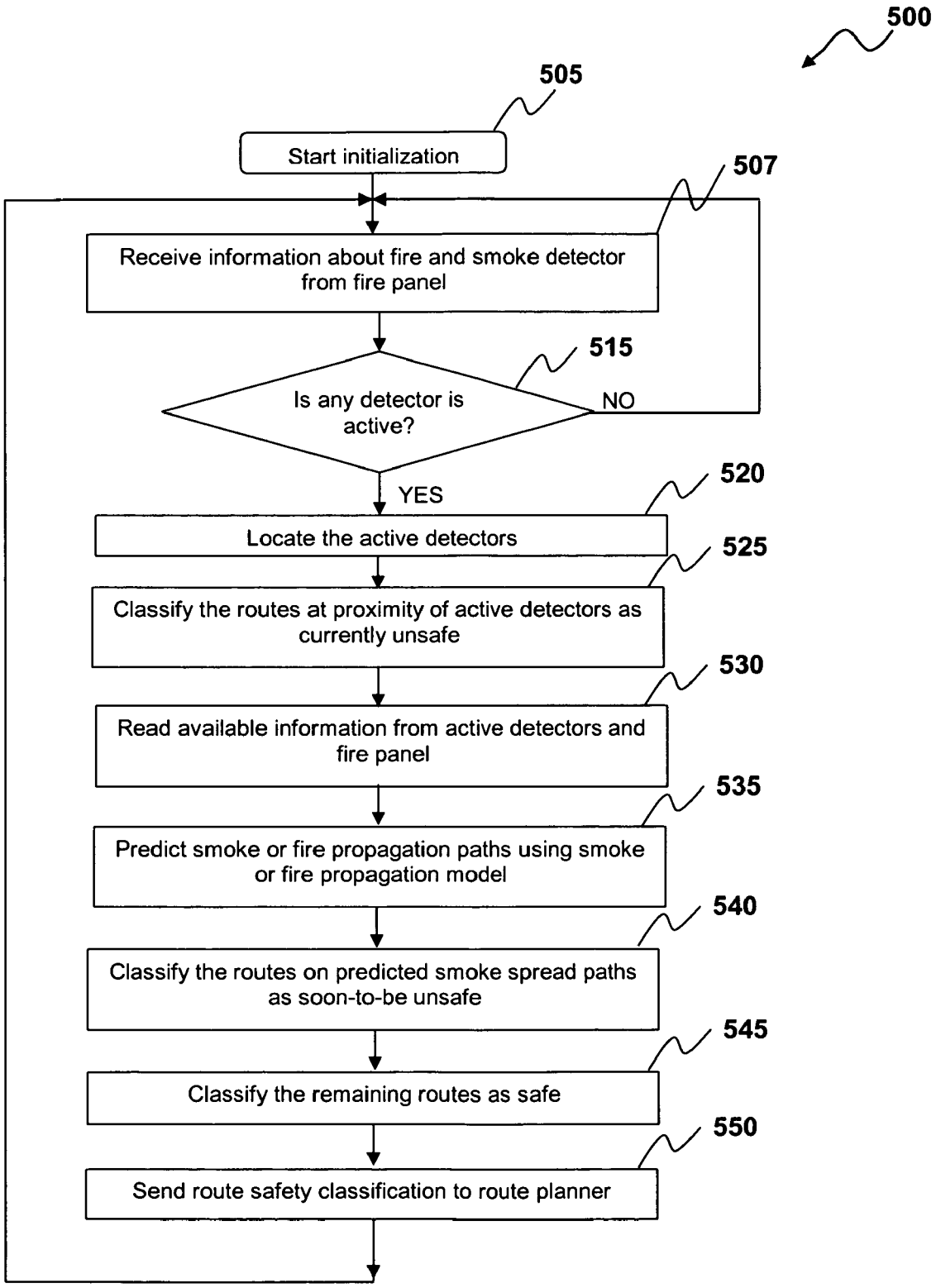
FIG. 5 illustrates a high-level flow chart of operations depicting an evacuation and safety route prediction method that can be utilized in association with the adaptive evacuation system depicted in FIG. 2, in accordance with a preferred embodiment.

FIG. 5 illustrates a high-level flow chart of operations depicting an evacuation and safety route prediction method 500 that can be utilized in association with the adaptive evacuation system 200 depicted in FIG. 2, in accordance with a preferred embodiment. Note that the method 500 depicted in FIG. 5 can be implemented in the context of a software module, such as module 122 depicted in FIG. 1. With knowledge of the location of fire and smoke hazards in the building, the system 200 depicted in FIG. 2 can plan safe routes and communicate them to occupants. The evacuation process initiates as indicated at block 505. As indicated at block 507, the system 200 depicted in FIG. 2, can receive information from a fire panel concerning currently active smoke and heat detectors 314, 313 and 301 depicted in FIG. 3. Thereafter, as depicted at block 515, the system 200 depicted in FIG. 2 checks whether any of the detectors 330-348 depicted in FIG. 3 are active. If none of the detectors 330-348 depicted in FIG. 3 are active, the system 200 depicted in FIG. 2 once again checks for the activation of detectors 330-348 depicted in FIG. 3 else the system 200 depicted in FIG. 2 locates the active detectors 314, 313 and 301 as indicated at block 520.

Thereafter, as depicted at block 525, routes and exits in proximity to the active detectors can be classified as "currently unsafe" and closed for use during an evacuation.

Evacuation planning can be accomplished with the remaining "safe" routes. Fires, however, are dynamic and often spread from one area to another over time. Smoke also spreads over time, often unintentionally aided by the building HVAC system. Therefore, what is a safe route now may not be a safe route in ten minutes. The system depicted in FIG. 2 reads the information available from active detectors and fire panel, as indicated at block 430. As depicted at block 535, the progression of fire and smoke and the time-dependent degradation of evacuation route safety associated with it can be predicted using a smoke or fire propagation model, such as the model 215 depicted in FIG. 2.

The fire/smoke propagation model 215 depicted in FIG. 2 can be utilized to predict the fire and smoke propagation paths using the information obtained from fire and smoke detectors. Thereafter, as described at block 540, when the fire progresses, the routes near the smoke spread paths are predicted as soon-to-be unsafe. The remaining routes are classified as "safe" as described at block 545. Thereafter as depicted at block 550, the safety route classification is sent to the route planner as depicted at FIG. 2 and the system as depicted at FIG. 2 once again checks for activation status of detectors 330-348 depicted at FIG. 3.

Figure 6:
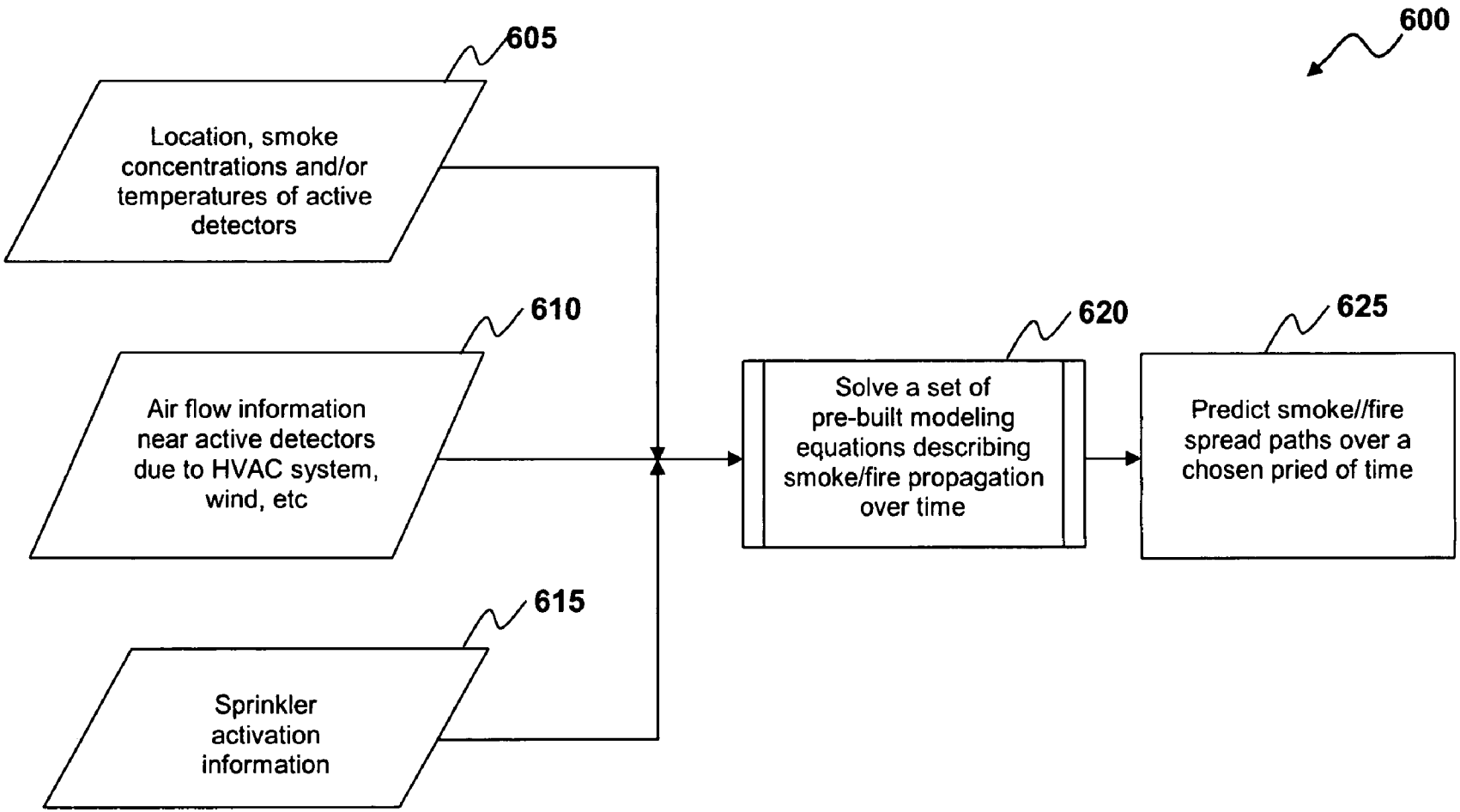
FIG. 6 illustrates a schematic diagram of a smoke or fire propagation model for predicting spread paths over a chosen time period, which can be implemented in accordance with a preferred embodiment.

FIG. 6 illustrates a schematic diagram of a smoke or fire propagation model 600 for predicting spread paths over a selected time period, d in accordance with a preferred embodiment. The propagation model can be configured as a set of partial differential and algebraic equations that describe smoke concentration and/or temperature distribution and its changes in space and over time. The model is constructed upon fundamental principles, such as the conservation of momentum, mass and energy of smoke particles, or simplified equations with reasonable assumptions, or empirical relations.

As depicted at blocks 605, 610 and 615, information regarding the location, smoke concentration and temperature of active detectors, the air flow information near active detectors due to an HVAC (Heating, Ventilation, Air-Conditioning) system, wind, etc and sprinkler activation information respectively can be provided as input to a fire or smoke propagation model. Thereafter as depicted at block 620, such a propagation model solves a set of pre-built modeling equations describing smoke or fire propagation over time. The smoke or fire spread paths over a chosen period of time are predicted as indicated at block 625.

Figure 7:
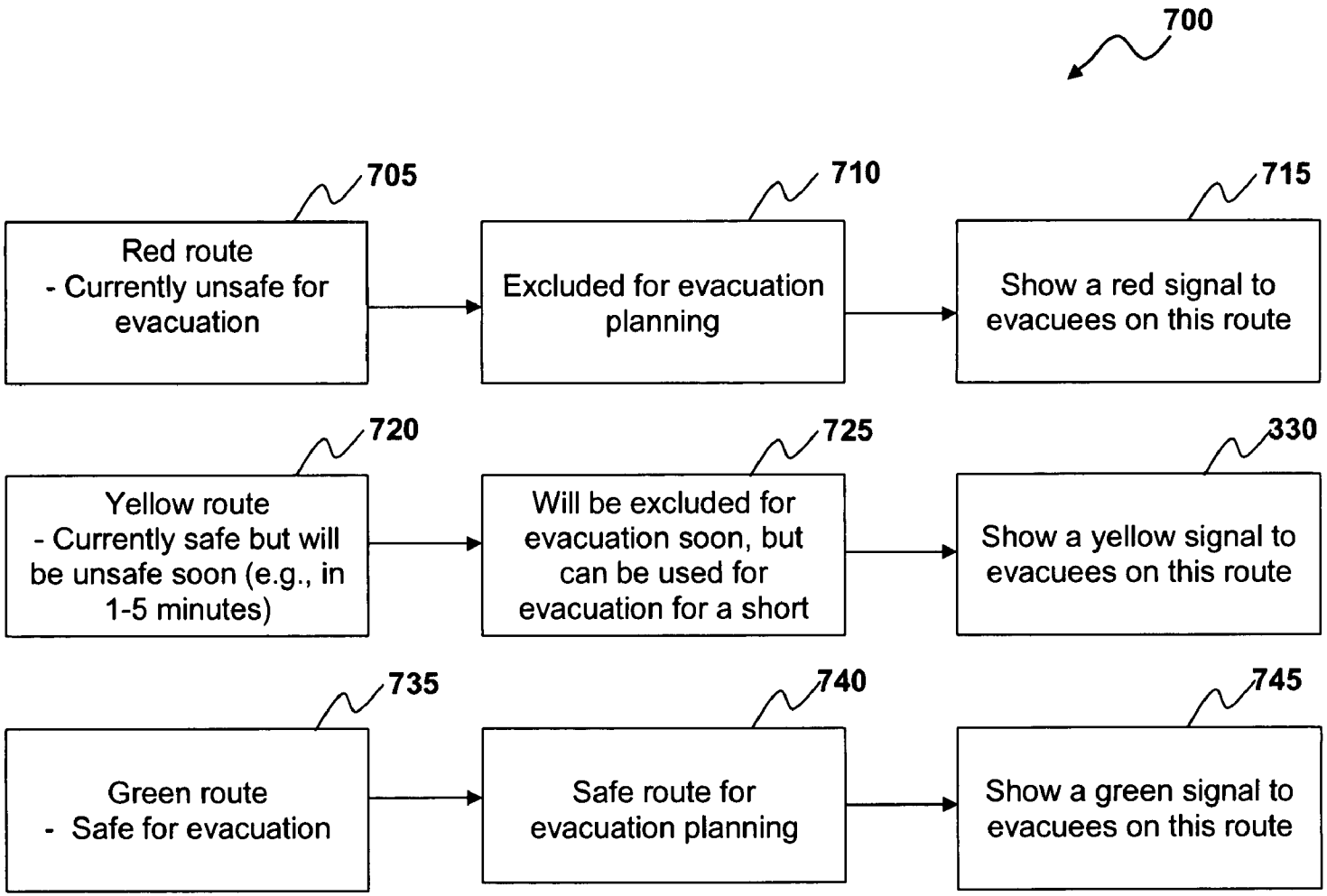
FIG. 7 illustrates a schematic diagram of a time-dependent classification and signaling of route safety for indicating safety levels of a current route and a route in a chosen time period (e.g., a few minutes), in accordance with a preferred embodiment.

FIG. 7 illustrates a schematic diagram 700 of a time-dependent classification and signaling of route safety for indicating safety levels of a current route and a route in a chosen time period (e.g., a few minutes), in accordance with a preferred embodiment. A route's safety level changes over time, depending on smoke spread paths and speeds predicted by propagation model. The passing time for each route is calculated from the route length and a normal evacuation speed. As depicted at block 705 red route indicates that the current route used by the evacuees is unsafe. As the red route is unsafe for evacuation it is excluded for evacuation planning, as indicated at block 710. Thereafter as described at block 715, the system 200 depicted in FIG. 2 shows a red signal to evacuees on this route.

As illustrated at block 720 yellow route indicates that the current route used by the evacuees is safe but will be unsafe soon (e.g., in 1-5 minutes). As the yellow route is safe but will be unsafe soon it will be excluded for evacuation soon, but can be used for evacuation planning for a short period of time (e.g., in 1-5 minutes), as indicated at block 725. Thereafter, as described at block 730, the system 200 depicted in FIG. 7 indicates a yellow signal to evacuees on this route.

As depicted at block 735 green route indicates that the current route used by the evacuees is safe. As the green route is safe it can be used for evacuation planning, as indicated at block 740. Thereafter as indicated at block 745, the system 200 depicted in FIG. 2 shows a green signal to evacuees on this route.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An adaptive evacuation method, comprising:

automatically generating data concerning a hazard from a plurality of hazard detectors monitoring a region of interest;

creating a prediction model that predicts how said hazard propagates over time from a current location of said hazard in order to evaluate, classify and communicate at least one safety evacuation route to at least one evacuee, thereby providing a time-dependent classification and signaling of said at least one evacuation route; and monitoring continuously said hazard in order to reevaluate, reclassify and recommunicate said at least one safety evacuation route to said at least one evacuee, thereby providing said time-dependent classification and signaling of said at least one evacuation route.

2. The method of claim 1 further comprising:

evaluating, predicting and classifying said at least one safety evacuation route utilizing a situation assessor.

3. The method of claim 1 further comprising:

computing at least one evacuation plan based on said at least one safety evacuation route utilizing a route planner.

4. The method of claim 3 further comprising:

providing a plurality of directional devices for communicating with said at least one evacuee within said region of interest.

5. The method of claim 4 further comprising:

controlling a signal concerning said at least one safety evacuation route based on said at least one evacuation plan and a location of said plurality of directional devices.

6. The method of claim 1 wherein said at least one safety evacuation route is obtained using a fire propagation model, which is used for predicting a fire spread path over a selected period of time.

7. The method of claim 1, wherein said at least one safety evacuation route is obtained using a smoke propagation model, which is used for predicting a smoke spread path over a selected period of time.

8. The method of claim 1, wherein said at least one safety evacuation route is obtained using a plurality of results from said plurality of hazard detectors, which is used for detecting a presence of smoke.

9. The method of claim 1, wherein said at least one safety evacuation route is obtained using a plurality of results from said plurality of hazard detectors, which is used for detecting a presence of a fire.

10. An adaptive evacuation system, comprising:

a data-processing apparatus;

a module executed by said data-processing apparatus, said module and said data-processing apparatus being operable in combination with one another to:

automatically generate data concerning a hazard from a plurality of hazard detectors monitoring a region of interest;

create a prediction model that predicts how said hazard propagates over time from a current location of said hazard in order to evaluate, classify and communicate at least one safety evacuation route to at least one evacuee, thereby providing a time-dependent classification and signaling of said at least one evacuation route; and monitor continuously said hazard in order to reevaluate, reclassify and recommunicate said at least one safety evacuation route to said at least one evacuee, thereby providing said time-dependent classification and signaling of said at least one evacuation route.

11. The system of claim 10 wherein said data-processing apparatus and said module are further operable in combination with one another to evaluate, predict and classify said at least one safety evacuation route utilizing a situation assessor.

12. The system of claim 10 wherein said data-processing apparatus and said module are further operable in combination with one another to compute at least one evacuation plan based on said at least one safety evacuation route utilizing a route planner.

13. The system of claim 12 further comprising:

a plurality of directional devices for communicating with said at least one evacuee within said region of interest.

14. The system of claim 13 wherein said data-processing apparatus and said module are further operable in combination with one another to control a signal concerning said at least one safety evacuation route based on said at least one evacuation plan and a location of said plurality of directional devices.

15. The system of claim 10 wherein said at least one safety evacuation route is obtained using a fire propagation model, which is used for predicting a fire spread path over a selected period of time.

16. The system of claim 10 wherein said at least one safety evacuation route is obtained using a smoke propagation model, which is used for predicting a smoke spread path over a selected period of time.

17. The system of claim 10 wherein said at least one safety evacuation route is obtained using a plurality of results from said plurality of hazard detectors, which is used for detecting a presence of smoke.

18. The system of claim 10 wherein said at least one safety evacuation route is obtained using a plurality of results from said plurality of hazard detectors, which is used for detecting a presence of a fire.

19. An adaptive evacuation system, comprising:

a plurality of detectors for monitoring a region of interest;

a prediction modeler for predicting how a hazard propagates over time from a current location of said hazard;

a situation assessor for continuously evaluating, predicting and classifying at least one safety route based on data obtained from said plurality of detectors;

a route planner for computing at least one safety evacuation plan based on said at least one safety evacuation route; and a plurality of directional devices for communicating with a plurality of evacuees in said region based on data obtained from said route planner, thereby providing a time-dependent classification and signaling of said at least one evacuation route.

20. The system of claim 10, further comprising:

a controller for controlling at least one route signal based on said at least one safety evacuation plan and a location of said plurality of directional devices.

* * * * *